US007419252B2

(12) United States Patent
Yasui

(10) Patent No.: US 7,419,252 B2
(45) Date of Patent: Sep. 2, 2008

(54) INK JET HEAD, PIEZO-ELECTRIC ACTUATOR, AND METHOD OF MANUFACTURING THEM

(75) Inventor: Motohiro Yasui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 510 days.

(21) Appl. No.: 11/179,675

(22) Filed: Jul. 13, 2005

(65) Prior Publication Data

US 2006/0012644 A1 Jan. 19, 2006

(30) Foreign Application Priority Data

Jul. 13, 2004 (JP) ..... 2004-206077

(51) Int. Cl.
*B41J 2/045* (2006.01)

(52) U.S. Cl. ..... 347/68; 347/70

(58) Field of Classification Search ..... 347/20, 347/54, 67, 68, 70–71
See application file for complete search history.

(56) References Cited

U.S. PATENT DOCUMENTS

| | | | | |
|---|---|---|---|---|
| 4,675,123 | A | 6/1987 | Tsunooka | 252/62.9 R |
| 5,637,126 | A | 6/1997 | Ema | 65/31 |
| 5,754,205 | A | 5/1998 | Migata et al. | 347/70 |
| 5,922,218 | A | 7/1999 | Migata et al. | 216/27 |
| 6,327,760 | B1 | 12/2001 | Yun | 29/25.35 |
| 6,347,862 | B1 | 2/2002 | Kanno | 347/68 |
| 2002/0149296 | A1 | 10/2002 | Fuji | 310/328 |
| 2004/0021745 | A1 | 2/2004 | Mouri | 347/68 |
| 2006/0012645 | A1* | 1/2006 | Nagashima | 347/68 |

FOREIGN PATENT DOCUMENTS

| | | | |
|---|---|---|---|
| EP | 0747976 | A1 | 12/1996 |
| EP | 0782923 | A1 | 7/1997 |
| EP | 0841165 | A2 | 5/1998 |
| EP | 0993953 | A2 | 4/2000 |
| EP | 1255307 | A1 | 11/2002 |
| EP | 1321294 | A2 | 6/2003 |
| EP | 1367658 | A1 | 12/2003 |
| JP | 1-208880 | A | 8/1989 |
| JP | 11-330577 | | 11/1999 |
| JP | 11-334087 | | 12/1999 |
| JP | 2001-152360 | A | 6/2001 |
| JP | 2003-020226 | A | 1/2003 |

OTHER PUBLICATIONS

Non-Final Office Action dtd Apr. 8, 2008, related U.S. Appl. No. 11/179,666.
EP Search Report dtd Aug. 18, 2005, EP Appln. 0515121.6.

* cited by examiner

*Primary Examiner*—Juanita D Stephens
(74) *Attorney, Agent, or Firm*—Banner & Witcoff, Ltd.

(57) ABSTRACT

An ink jet head is provided with a channel body and a piezo-electric actuator connected with the channel body. The channel body is provided with a plurality of ink flow channels. Each of the ink flow channel has a pressure chamber and a nozzle connected with the pressure chamber. The piezo-electric actuator is provided with a piezo-electric layer. The piezo-electric layer has a plurality of high piezo-electric characteristic areas and a low piezo-electric characteristic area. Each of the high piezo-electric characteristic areas faces each of the pressure chambers of the channel body. The low piezo-electric characteristic area faces an intermediate area between the pressure chambers.

14 Claims, 6 Drawing Sheets

INK JET HEAD, PIEZO-ELECTRIC ACTUATOR, AND METHOD OF MANUFACTURING THEM

CROSS-REFERENCE TO RELATED APPLICATION

This application claims priority to Japanese Patent Application No. 2004-206077, filed on Jul. 13, 2004, the contents of which are hereby incorporated by reference into the present application.

BACKGROUND OF THE INVENTION

1. Field of the Invention

The present invention relates to an ink jet head. The present invention also relates to a piezo-electric actuator. Moreover, the present invention relates to a method of manufacturing the ink jet head and the piezo-electric actuator.

2. Description of the Related Art

Piezo-electric actuators are utilized for a variety of purposes. A piezo-electric actuator has electrodes formed at a top surface and a bottom surface of a layer (a piezo-electric layer) formed from a material that deforms when voltage is applied between the electrodes at the top surface and the bottom surface of the material. The shape of the piezo-electric layer can be changed by controlling the potential applied between the electrodes on the top surface and the bottom surface. Dividing at least one of the electrodes into a plurality of independent electrodes makes it possible to control the difference in potential applied to each part of the piezo-electric layer. One of the purposes of piezo-electric actuators is to drive an ink jet head used in an ink jet printer.

Ink jet printers are well known. An ink jet printer is provided with an ink jet head that discharges ink. A conventional ink jet head is taught in Japanese Patent Application Publication No. 11-334087 (1999-334087).

The ink jet head is provided with a channel body and the piezo-electric actuator. A plurality of ink flow channels is formed in the channel body. Each ink flow channel is provided with a pressure chamber and a nozzle connected with the pressure chamber. The pressure chambers are formed at a surface of the channel body and exposed to an outside of the channel body. The pressure chambers are distributed across the surface of the channel body.

The piezo-electric actuator is stacked on the channel body. The piezo-electric actuator has a broad, sheet shaped piezo-electric layer. The piezo-electric actuator seals the pressure chambers from atmosphere when stacked on the surface of the channel body. A plurality of first electrodes is disposed on a front surface of the piezo-electric layer in the same distribution pattern as that of the pressure chambers. A second electrode is disposed on a back surface of the piezo-electric layer. The second electrode covers approximately the entire back surface of the piezo-electric layer. In usual, the piezo-electric actuator is stacked on the channel body so that the second electrode is located between the piezo-electric layer and the channel body.

Applying voltage to one of these first electrodes deforms the piezo-electric layer at a location between the second electrode and the first electrode to which the voltage is being applied. When the first electrode to which the voltage is being applied is shifted, deforming portion within the piezo-electric layer is also shifted. That is, the piezo-electric actuator includes a plurality of piezo-electric elements, and each piezo-electric element deforms when voltage is applied to the first electrode of that piezo-electric element. A single piezo-electric element is formed from a combination of one of the first electrode, a part of the piezo-electric layer facing that first electrode, and a part of the second electrode facing that first electrode.

When the piezo-electric actuator is stacked on the channel body, each of the piezo-electric elements faces each of the pressure chambers. When the piezo-electric element expands, capacity of the pressure chamber corresponding to that piezo-electric element is reduced, pressure within that pressure chamber is increased, and ink is discharged from the nozzle connected to the pressurized pressure chamber.

Selection of the first electrode to which voltage is being applied causes a selection of the expanding location within the piezo-electric layer. In the ink jet head with the above configuration, it is possible to select a particular nozzle by selecting single first electrode to which voltage will be applied tom the plurality of first electrodes. It is also possible to control whether the selected nozzle discharges or does not discharge ink by changing the voltage applied to the selected first electrode.

BRIEF SUMMARY OF THE INVENTION

In the case where the voltage being applied to the selected first electrode is changed, a part of the piezo-electric layer corresponding to the selected first electrode deforms. Since the piezo-electric layer has a continuous sheet shape, when a particular portion thereof is deformed, the area surrounding that portion also deforms. As a result, when the voltage of the selected first electrode is changed, there may also be a deformation of the piezo-electric layer at portions that correspond to adjoining first electrodes around the selected first electrode. That is, when pressure is increased or reduced at the selected pressure chamber, there may also be an increase or reduction in pressure at adjoining pressure chambers around the selected pressure chamber. This phenomenon will be referred to below as crosstalk phenomenon. In this case, there is discharge of ink at an unintended time from an unintended nozzle, or ink is discharged by an unintended amount or at an unintended speed. This phenomenon causes unintended printing patterns.

In recent years, nozzles have come to be disposed with a higher density in order to improve printing quality. Therefore, the pressure chambers also have come to be disposed with a higher density. The distance between adjoining pressure chambers has become very small. This means that piezo-electric elements also have come to be disposed with a higher density. As a result, the crosstalk phenomenon has become very serious, and has become a great problem.

Furthermore, the piezo-electric actuator is also utilized for a device besides printer. In various field, a piezo-electric actuator which has a plurality of piezo-electric elements with a higher density is needed. The crosstalk phenomenon caused by the piezo-electric elements with the higher density has become a problem in various field.

In the present invention, the aforementioned problem has been taken into consideration, and a technique is taught that can reduce the occurrence of the crosstalk phenomenon.

The ink jet head taught in the present specification includes a channel body and a piezo-electric actuator. A piezo-electric layer of the piezo-electric actuator has a plurality of high piezo-electric characteristic auras and a low piezo-electric characteristic area located between the high piezo-electric characteristic areas. The high piezo-electric characteristic areas are distributed within the low piezo-electric characteristic area of the piezo-electric layer. Each of the high piezo-electric characteristic areas faces each of the pressure chambers. The low piezo-electric characteristic area faces an intermediate area between the pressure chambers.

The high piezo-electric characteristic areas deform more readily than the low piezo-electric characteristic area in response to the voltage applied. The low piezo-electric characteristic area deforms less readily than the high piezo-electric characteristic areas in response to piezo-electric effects.

In this ink jet head, the high piezo-electric characteristic areas of the piezo electric layer are facing the pressure chambers, and the low piezo-electric characteristic area is facing the intermediate area between the pressure chambers. When the high piezo-electric characteristic area deforms, pressure of the pressure chamber corresponding to the high piezo-electric characteristic area is increased or reduced. The low piezo-electric characteristic area surrounding the high piezo electric characteristic area does not readily deform even when the high piezo-electric characteristic area has deformed. It is therefore possible to prevent the phenomenon wherein the deformation of a high piezo-electric characteristic area causes the deformation of an adjoining high piezo-electric characteristic area. The occurrence of the crosstalk phenomenon can therefore be reduced. High quality printing can be realized using this ink jet head.

DETAILED DESCRIPTION OF THE INVENTION

First Embodiment

Figure 2:
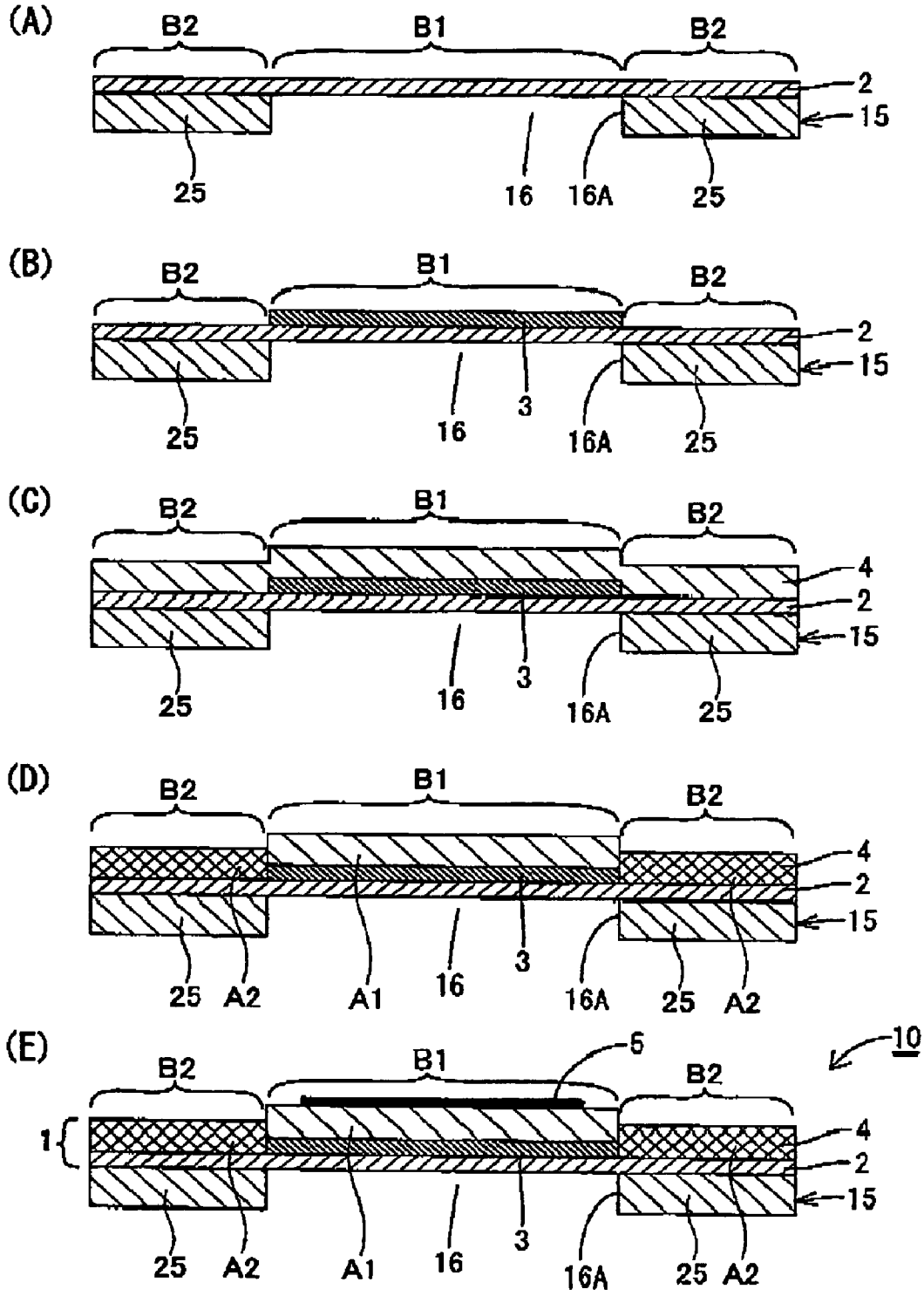
FIG. 2 shows a manufacturing process of a piezo-electric actuator of the first embodiment; (A) shows a state where a vibration plate has been joined with a pressure chamber plate. (B) shows a state where a bottom electrode has been formed. (C) shows a state where a piezo-electric layer has been formed. (D) shows a state after annealing. (E) shows a state where a top electrode has been formed.
Figure 3:
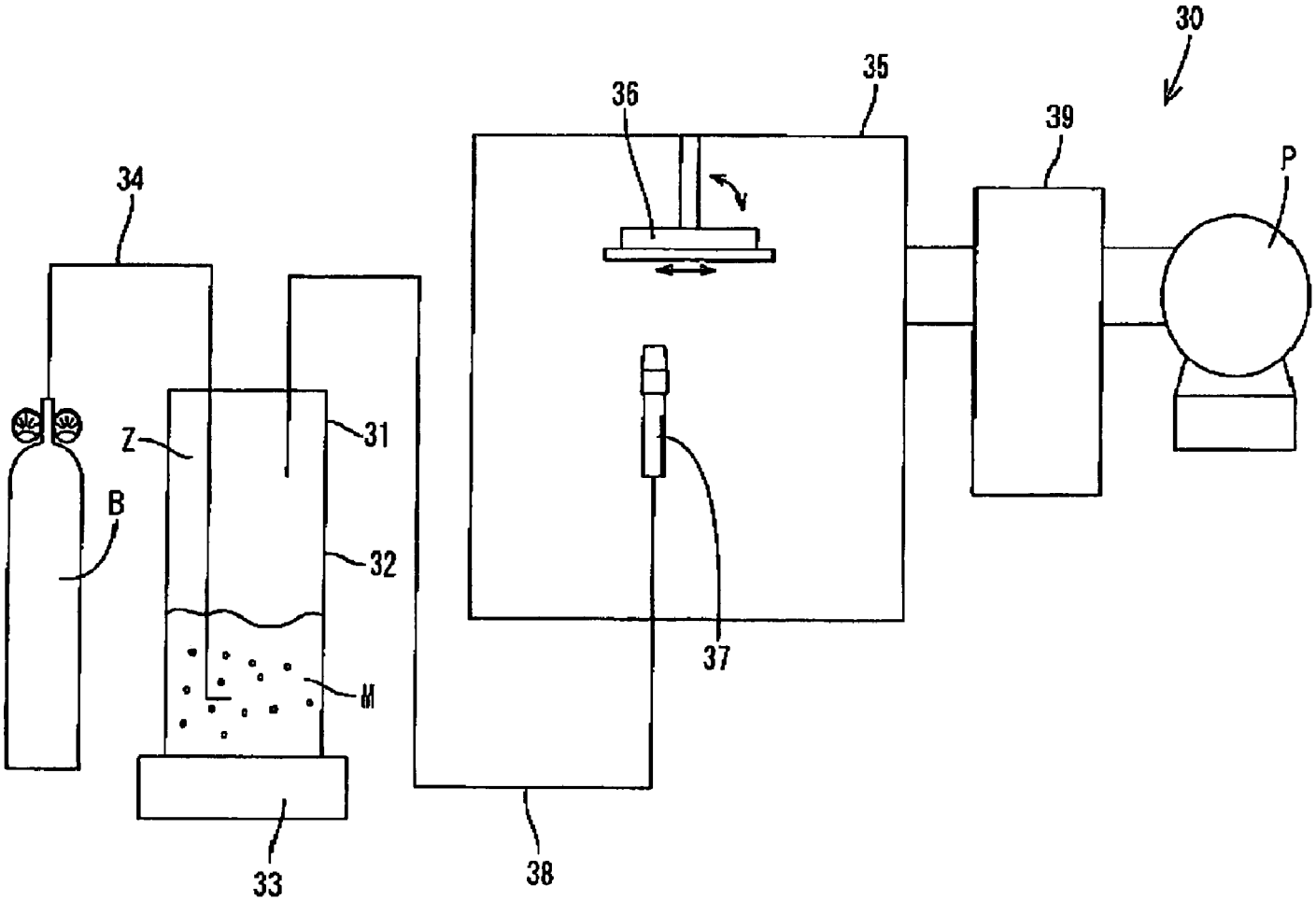
FIG. 3 shows a schematic diagram of a piezo-electric layer forming device.

A first embodiment will be described with reference to FIGS. 1 to 3.

Figure 1:
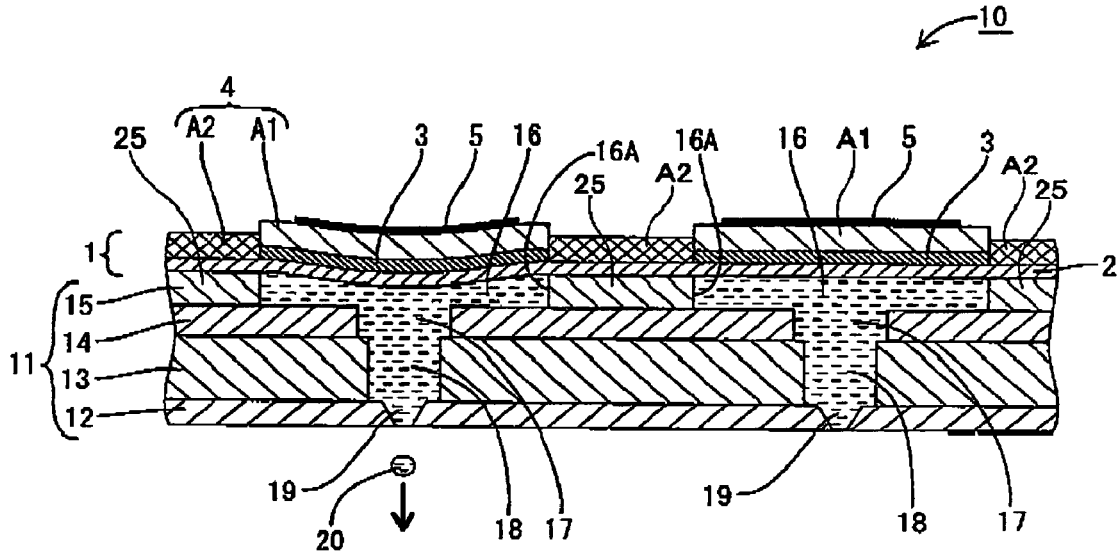
FIG. 1 shows a longitudinal sectional view of an ink jet head of a first embodiment.

An ink jet head 10 of the present embodiment is shown in FIG. 1. The ink jet head 10 is mounted on a member termed a carriage (not shown) of an ink jet printer. The carriage is capable of moving in a direction orthogonal to a direction in which a print medium is transported. The ink jet head 10 discharges ink.

The ink jet head 10 is provided with a channel body 11 and a piezo-electric actuator 1. The channel body 11 is provided with a plurality of pressure chambers 16 in which ink 20 is housed. The piezo-electric actuator 1 is stacked on the channel body 11 such that this piezo-electric actuator 1 seals openings at an upper side of the pressure chambers 16.

The channel body 11 has a nozzle plate 12, a manifold plate 13, a flow channel plate 14, and a pressure chamber plate 15. The channel body 11 is a structure in which the plates 12, 13, 14, and 15 are joined together by an epoxy thermosetting adhesive.

The nozzle plate 12 is formed from polyimide synthetic resin. A plurality of nozzles 19 are formed in the nozzle plate 12. Each of the nozzles 19 passes through the nozzle plate 12 in an up-down direction Each of the nozzles 19 grows smaller in diameter toward its lower side. The nozzles 19 discharge ink droplets 20.

The manifold plate 13 joins with an upper face of the nozzle plate 12. The manifold plate 13 is formed from a metal material such as stainless steel, etc. The manifold plate 13 has a plurality of holes 18 that pass therethrough in an up-down direction. A lower end of the hole 18 joins with the nozzle 19. An upper end of the hole 18 joins with a hole 17 of the flow channel plate 14 (to be described). The holes 18 function as ink flow channels. Below, the holes 18 will be referred to as MP holes. Although this is not shown, a common ink chamber is formed in the manifold plate 13. This common ink chamber joins with an ink tank (not shown). Furthermore, the common ink chamber joins with ink flow channels (second FP holes; not shown) of the flow channel plate 14.

The flow channel plate 14 joins with an upper ace of the manifold plate 13. The flow channel plate 14 is formed from a metal material such as stainless steel, etc. The flow channel plate 14 has a plurality of holes 17 that pass therethrough in an up-down direction. A lower end of the hole 17 joins with the hole 18. An upper end of the hole 17 joins with the pressure chamber 16 of the pressure chamber plate 15 (to be described). The holes 17 function as ink flow channels. Below, the holes 17 will be referred to as first FP holes. Although this is not shown, other through holes (second FP holes) are formed in the flow channel plate 14. One end of the second FP hole joins with the pressure chamber 16, and the other end joins with the common ink chamber. As described above, the common ink chamber is formed in the manifold plate 13.

The pressure chamber plate 15 joins with an upper face of the flow channel plate 14. The pressure chamber plate 15 is formed from a metal material such as stainless steel, etc. The pressure chamber plate 15 has a plurality of pressure chambers 16. The pressure chambers 16 pass through the pressure chamber plate 15 in an up-down direction. The pressure chambers 16 join with an upper end of the first FP holes 17. Further, the pressure chambers 16 join with the ink tank via the second FP holes and the common ink chamber. The ink in the ink tank is transmitted to the nozzles 19 via the common ink chamber, the second FP holes, the pressure chambers 16, the first FP holes 17, and the MP holes 18. The pressure chambers 16 are exposed to atmosphere at an upper face of the channel body 11. The pressure chambers 16 are distributed across the upper face of the channel body 11 in a predetermined pattern.

The piezo-electric actuator 1 is provided with a vibration plate 2, bottom electrodes 3, a piezo-electric layer 4, and top electrodes 5.

The vibration plate 2 is formed as one broad sheet. The vibration plate 2 joins with an upper face of the pressure chamber plate 15 of the channel body 11. An epoxy thermosetting adhesive is used to effect this join. The vibration plate 2 is formed in a rectangular shape from a metal material such as stainless steel (SUS 430, SUS 304, etc.), 42A alloy, etc. The vibration plate 2 covers the entirety of the upper face of the pressure chamber plate 15. The vibration plate 2 covers the plurality of pressure chambers 16. The openings at the upper side of the pressure chambers 16 are sealed by the vibration plate 2.

The plurality of bottom electrodes 3 is formed on an upper face of the vibration plate 2. Each of the bottom electrodes 3 is disposed directly above one of each of the pressure chambers 16. Each of the bottom electrodes 3 faces each of the pressure chambers 16. Each bottom electrode 3 is connected with a ground of a driver circuit IC (not shown). The bottom electrodes 3 also function as a protecting layer for preventing an element contained in the vibration plate 2 from being diffused toward the piezo-electric layer 4. Material that can be used to form the bottom electrodes 3 includes, for example:

(1) a metal film of: Au, Pt, Ti, Ag—Pd alloy, Ag—Pt alloy, Rh, In, La, Nd, Nb, Sb, Th, W, Ca, Sr, Mg, etc;

(2) a conductive oxidized layer of: $LiNiO_2$, $LiCoO_2$, $ReO_3$, SnO, $TiO_2$, $LiTi_2O_4$, $LiV_2$, $M_xWO_3$ (M being any desired metal, and this being the case below also), $M_xV_2O_5$, $M_xM_6O_3$, $V_2O_3$, $Fe_{O4}$, $MgIn_2O_4$, $RuO_2$, $La_{1-x}Sr_xMnO_3$ (LSMO), $(La_{1-x}Sr_x)$ (Ga indium tin oxide (ITO), $SrRuO_3$ (SRO), $La_{2-x}Sr_xCoO_4$ (LSCO), etc.;

(3) alumina; or (4) graphite.

The piezo-electric layer 4 is formed of a piezo-electric ceramic material that is ferroelectric, such as lead zirconate titanate (PZT). The piezo-electric layer 4 is formed as one broad sheet. The piezo-electric layer 4 extends across the plurality of pressure chambers 16.

The piezo-electric layer 4 has two areas A1 and A2. The areas A1 face the pressure chambers 16. The area A2 faces an intermediate area 25 between the pressure chambers 16. The areas A1 are present in the same number as the number of pressure chambers 16. Each of the areas A1 faces the pressure chambers 16 via the bottom electrode 3 and the vibration plate 2. The area A2 is a single area that is mutually connected. The plurality of areas A1 is distributed in a staggered shape within the continuous area A2. The piezo-electric layer 4 is formed by means of an aerosol deposition method (to be described in detail later). A polarization process is performed on the piezo-electric layer 4 so as to generate polarization in its direction of thickness.

The area A2 of the piezo-electric layer 4 makes direct contact with the vibration plate 2. As will be described in detail later, an element contained in the vibration plate 2, such as Fe or Cr, is diffused in the area A2 during annealing process. The Fe or Cr is an element of a differing type (heteroelement) than the element contained in the PZT forming the piezo-electric layer 4. The Fe or Cr degrades the piezo-electric characteristics of the piezo-electric layer 4. That is, the Fe or Cr diffused in the area A2 weakens the piezo-electric effects, and increases the strength of a driving electric field. That is, almost no deformation is caused in the area A2 in which the Fe or Cr is diffused even if electric field is applied.

The plurality of top electrodes 5 is formed on an upper face of the piezo-electric layer 4. Each of the top electrodes 5 joins with an upper face of each of the areas A1 of the piezo-electric layer 4. That is, each of the top electrodes 5 faces each of the pressure chambers 16. Each of the top electrodes 5 is connected with a driver circuit IC.

The bottom electrodes 3 and the top electrodes 5 may also be termed individual electrodes, since they are provided for each of the pressure chambers 16. This may be contrasted with a configuration in which one of these electrodes is one single electrode layer. In the second and third embodiments described below, for example, the bottom electrodes are configured as one single electrode layer. This electrode may be termed a common electrode.

Next, a manufacturing process of the ink jet head 10 will be described with reference to FIG. 2. In particular, a manufacturing process of the piezo-electric actuator 1 will be described in detail in the present representative embodiment.

First, the channel body 11 is provided. The channel body 11 can be manufactured by using a known method. In FIG. 2, only the pressure chamber plate 15 of the channel body 11 is shown, and the plates 12 to 14 below the pressure chamber plate 15 are not shown. Further, only a part of the pressure chamber plate 15 and the piezo-electric actuator 1 that extend along a left-right direction is shown.

Next, as shown in FIG. 2(A), the stainless steel vibration plate 2 is joined with the upper face of the pressure chamber plate 15. At this juncture, the vibration plate 2 is positioned so as to cover approximately the entire upper face of the pressure chamber plate 15. The openings at the upper side of each of the pressure chambers 16 are sealed by the vibration plate 2. The vibration plate 2 is formed from stainless steel. The pressure chamber plate 15 contains Fe elements or Cr elements.

Next, as shown in FIG. 2(B), the plurality of bottom electrodes 3 is formed on the upper face of the stainless steel vibration plate 2. Each bottom electrode 3 is formed in an area B1 that faces the pressure chamber 16. The bottom electrodes 3 can be formed by, for example, a screen printing method. The bottom electrodes 3 also function to prevent the diffusion of the Fe or Cr elements contained in the vibration plate 2. The areas B1 of the vibration plate 2 are covered by the bottom electrodes 3, whereas an area B2 of the vibration plate 2 is not covered by the bottom electrodes 3. The area B2 of the vibration plate 2 forms a diffusion material area for supplying Fe or Cr to the piezo-electric layer 4 (formed in a following process).

Next, the piezo-electric layer 4 is formed as shown in FIG. 2(C). The piezo-electric layer 4 is formed by means of the aerosol deposition method (AD method). A layer forming device 30 for forming the piezo-electric layer 4 is described with reference to FIG. 3. The layer forming device 30 is provided with an aerosol generating device 31 and a layer forming chamber 35, etc. The aerosol generating device 31 diffuses material particles M in a carrier gas to form an aerosol Z. The layer forming chamber 35 causes the aerosol Z to be sprayed from a spray nozzle 37 and adhere to a base plate.

The aerosol generating device 31 is provided with an aerosol housing 32 capable of housing the material particles M, and a shaker 33 attached to the aerosol housing 32. The shaker 33 shakes the aerosol housing 32. One end of an introducing tube 34 is inserted into the aerosol housing 32. This end is disposed so as to be submerged in the material particles M in the vicinity of a base face of the aerosol housing 32. The other end of the introducing tube 34 is connected with a gas cylinder B that stores the carrier gas. The carrier gas can be, for example, an inert gas such as helium, argon, nitrogen, etc., or air, oxygen, etc.

The layer forming chamber 35 is provided with a stage 36 and the spray nozzle 37. The base plate is attached to the stage 36. The spray nozzle 37 is formed below the stage 36. The stage 36 can move in the direction shown by the arrow in the figure. The spray nozzle 37 is connected with the aerosol housing 32 via an aerosol supply tube 38. The aerosol Z passes through the aerosol supply tube 38 and is sprayed into the layer forming chamber 35 from the spray nozzle 37. A vacuum pump P is connected with the layer forming chamber 35 via a powder recovery device 39. Pressure within the layer forming chamber 35 can be reduced by means of the vacuum pump P.

The piezo-electric layer 4 can be formed in the following manner by using the layer forming device 30.

First, a surface side (an upper side in FIG. 1) of the base plate (the vibration plate 2) is turned to face downward, and the base plate is set on the stage 36. Next, the material particles M are introduced into the aerosol housing 32. Lead zirconate titanate (PZT), for example, can be used for the material particles M. The carrier gas is introduced into the aerosol housing 32 from the gas cylinder B. The gas pressure of the carrier gas causes the material particles M to rise. At this juncture, the shaker 33 shakes the aerosol housing 32. The material particles M and the carrier gas are thus mixed, and form the aerosol Z.

Next, the pressure within the layer forming chamber 35 is reduced by the vacuum pump P. This causes a difference in pressure between the aerosol housing 32 and the layer forming chamber 35. The pressure difference causes the aerosol Z in the aerosol housing 32 to be transported to the layer forming chamber 35. The aerosol Z that is being accelerated to a high velocity is sprayed from the spray nozzle 37. The material particles M contained in the aerosol Z collide with and accumulate on the vibration plate 2. The piezo-electric layer 4 is thus formed.

As shown clearly in FIG. 2(C), the piezo-electric layer 4 is formed from the areas B1 formed on the upper face of the bottom electrodes 3, and from the area B2 formed on the upper face of the vibration plate 2.

When the piezo-electric layer 4 has been formed, an annealing process of the piezo-electric layer 4 is performed. This annealing process is simultaneously combined with a diffusing process for diffusing the Fe or Cr contained in the vibration plate 2 into the piezo-electric layer 4. That is, while the piezo-electric layer 4 is annealed by means of being heated, the Fe or Cr contained in the vibration plate 2 diffuses into the piezo-electric layer 4.

The annealing process will be described in more detail with reference to FIG. 2(D). The Fe or Cr contained in the vibration plate 2 is not diffused to the piezo-electric layer 4 from the areas B1 of the vibration plate 2. This is because the bottom electrodes 3 prevent the elements from being diffused. As a result, the high piezo-electric characteristic areas A1 are formed in the piezo-electric layer 4. By contrast, the Fe or Cr contained in the areas B2 of the vibration plate 2 is diffused into the piezo-electric layer 4. As a result, the low piezo-electric characteristic area A2 is formed in the piezo-electric layer 4.

In the present representative embodiment, the annealing process of the piezo-electric layer 4, and the process for causing the diffusion of materials that degrade piezo-electric characteristics are performed simultaneously. It is therefore possible to improve manufacturing efficiency.

Next, the plurality of top electrodes 5 is formed, as shown in FIG. 2(E). Each of the top electrodes 5 is formed on the upper face of one of each of the high piezo-electric characteristic areas A1. In this process, a lead part (not shown) is formed that is connected with each of the top electrodes 5. For example, a cognitive film is formed across the entire area of the upper face of the piezo-electric layer 4, and then photo lithographic etching is performed. The top electrodes 5 can thus be formed. For example, furthermore, the top electrodes 5 can be formed by screen printing directly onto the upper face of the high piezo-electric characteristic areas A1.

Finally, an electric field is applied between the top electrodes 5 and the bottom electrodes 3. This electric field is stronger than a normal electric field applied during an ink discharging operation. As a result, the piezo-electric layer 4 is polarized in its direction of thickness between the two electrodes (a polarization process).

The ink jet head 10 is completed by means of performing each of the above processes.

Next, the operation and effects of the inkjet head 10 will be described with reference to FIG. 1. Here, a case is described in which the high piezo-electric characteristic area A1 at the left side of FIG. 1 will be deformed. Below, the description 'left side' will be omitted.

For discharging ink, the voltage of the top electrodes 5 is increased to be higher than the voltage of the bottom electrodes 3 by means of the driver circuit IC for generating a driving signal. An electric field (here, this will be termed the normal driving electric field) is thus applied to the piezo-electric layer 4 in its direction of polarization (its direction of thickness). The high piezo-electric characteristic area A1 of the piezo-electric layer 4 expands in the direction of thickness while contracting in a planar direction. The high piezo-electric characteristic area A1 thus protrudes downward (unimorph deformation). When the high piezo-electric characteristic area A1 protrudes downward, parts of the vibration plate 2 that correspond to the A1 also protrude downward. The capacity of the pressure chamber 16 is reduced, and pressure of the ink within the pressure chamber 16 is increased. The ink droplets 20 that have been pressurized are discharged from the nozzle 19. Thereupon, the top electrode 5 and the bottom electrode 3 are returned to a state having identical voltage. The high piezo-electric characteristic area A1 and the vibration plate 2 return to their original shape. The capacity of the pressure chamber 16 increases, and this causes ink to be transported from the ink tank to the pressure chamber 16.

The area A2 of the piezo-electric layer 4 contains the Fe or Cr that has been diffused from the vibration plate 2. The strength of the normal driving electric field is set such that deformation of the area A2 will not occur. Although there is a possibility that the area A2 deforms when a large voltage is applied, the strength of the normal driving electric field is set such that such deformation will not occur. As a result, when voltage is applied to the top electrode 5 that corresponds to the nozzle 19 from which the ink 20 should be discharged, the high piezo-electric characteristic area A1 corresponding to this nozzle 19 deforms, whereas the low piezo-electric characteristic area A2 surrounding this high piezo-electric characteristic area A1 is barely deformed. As a result, the high piezo-electric characteristic areas A1 adjoining the deformed high piezo-electric characteristic area A1 via the low piezo-electric characteristic area A2 are barely deformed. With the present embodiment, it is possible to effectively reduce the phenomenon wherein, when pressure of one of the pressure chambers 16 is increased or reduced, the pressure in the adjoining pressure chambers 16 is also increased or reduced. The occurrence of the crosstalk phenomenon can therefore be effectively reduced.

With the present embodiment, an element (Fe or Cr) that degrades piezo-electric characteristics has been diffused in the area A2 that does not correspond to the pressure chambers 16. The area A2 in which this element has been diffused has degraded piezo-electric effects, and is barely deformed by the normal driving electric field. As a result, it is possible to prevent the phenomenon wherein there is a discharge of ink at an unintended time from an unintended nozzle 19, or wherein ink is discharged at an unintended speed or by an unintended amount from a nozzle 19 from which ink discharge is intended.

Further, with the present embodiment, the vibration plate 2 contains the element that degrades piezo-electric characteristics, and this element is diffused into the piezo-electric layer 4. Conventionally, stainless steel could not be used as a vibration plate without very special treatment, because stainless steel includes the elements that degrade piezo-electric characteristics. In the present embodiment, the material that was conventionally difficult to use is being utilized positively.

Moreover, with the present embodiment, the bottom electrodes 3 are being used as a protecting layer. Since it is not necessary to form a separate protecting layer, the configuration of the piezo-electric actuator 1 can be simplified. The piezo-electric actuator 1 can therefore be manufactured simply, and manufacturing costs can be reduced.

Second Embodiment

Figure 4:
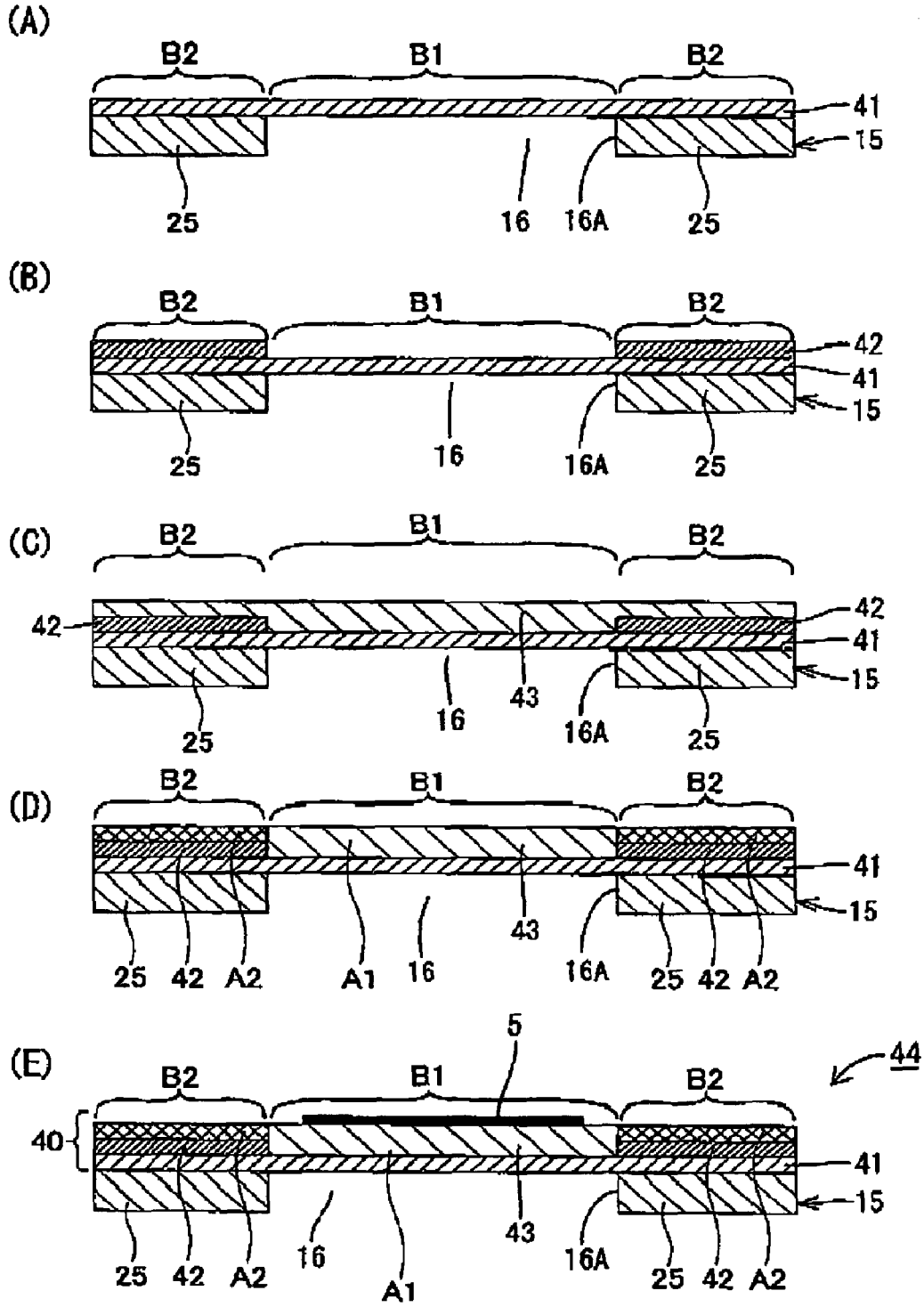
FIG. 4 shows a manufacturing process of a piezo-electric actuator of a second embodiment; (A) shows a state where a vibration plate has been joined with a pressure chamber plate. (B) shows a state where a diffusion material layer has been formed. (C) shows a state where a piezo-electric has been formed.

Next, a second embodiment will be described with reference to FIG. 4. In the present embodiment, a vibration plate 41 does not supply an element that degrades piezo-electric characteristics to a piezo-electric layer 43. Instead, a diffusion material layer 42 formed above the vibration plate 41 supplies this element to the piezo-electric layer 43. Moreover, components that are identical with the first embodiment have the same reference numbers applied thereto.

As shown in FIG. 4(A), the vibration plate 41 is joined with the upper face of the pressure chamber plate 15. The openings at the upper side of the pressure chambers 16 are sealed by the vibration plate 41. The vibration plate 41 is formed from a conductive metal that does not contain an element that degrades piezo-electric characteristics (e.g. titanium, etc.). The vibration plate 41 simultaneously functions as a bottom electrode. In this embodiment, a common bottom electrode is used.

Next, the diffusion material layer 42 is formed on an upper face of the areas B2 of the vibration plate 41 (see FIG. 4(B)). The diffusion material layer 42 contains an element (such as Fe) that is diffused into the piezo-electric layer 43 and that degrades piezo-electric characteristics. The diffusion material layer 42 is sheet shaped. Through holes are formed in the diffusion material layer 42 at positions facing each of the pressure chambers 16. The diffusion material layer 42 may be formed by, for example, the screen printing method Alterative, the diffusion material layer 42 may be formed by the aerosol deposition method (AD method) on the vibration plate 41 that has a resin or metal mask.

Next, the piezo-electric layer 43 is formed as shown in FIG. 4(C). The piezo-electric layer 43 can be formed by means of the AD method, as in the first embodiment. The piezo-electric layer 43 has the portions B2 that are formed at the upper face of the diffusion material layer 42, and the portions B1 that are formed directly on an upper face of the vibration plate 41.

Next, an annealing process of the piezo-electric layer 43 is performed (see FIG. 4(D)). This annealing process is simultaneously combined with a diffusing process for diffusing the Fe contained in the diffusion material layer 42 toward the piezo-electric layer 43. In the present embodiment, while the piezo-electric layer 43 is being annealed, the Fe contained in the diffusion material layer 42 diffuses toward the piezo-electric layer 43. The area A2 of the piezo-electric layer 43 thus becomes an area in which the Fe has been diffused.

Thereupon, the top electrodes 5 are formed in the same manner as in the first embodiment (see FIG. 4(E)). The piezo-electric actuator 40 is completed by performing the polarization process.

With the present embodiment, also, the piezo-electric layer 43 having the high piezo-electric characteristic areas A1 and the low piezo-electric characteristic area A2 can be manufactured simply. It is therefore possible to manufacture an ink jet head 44 in which the occurrence of the crosstalk phenomenon can effectively be reduced.

Third Embodiment

Figure 5:
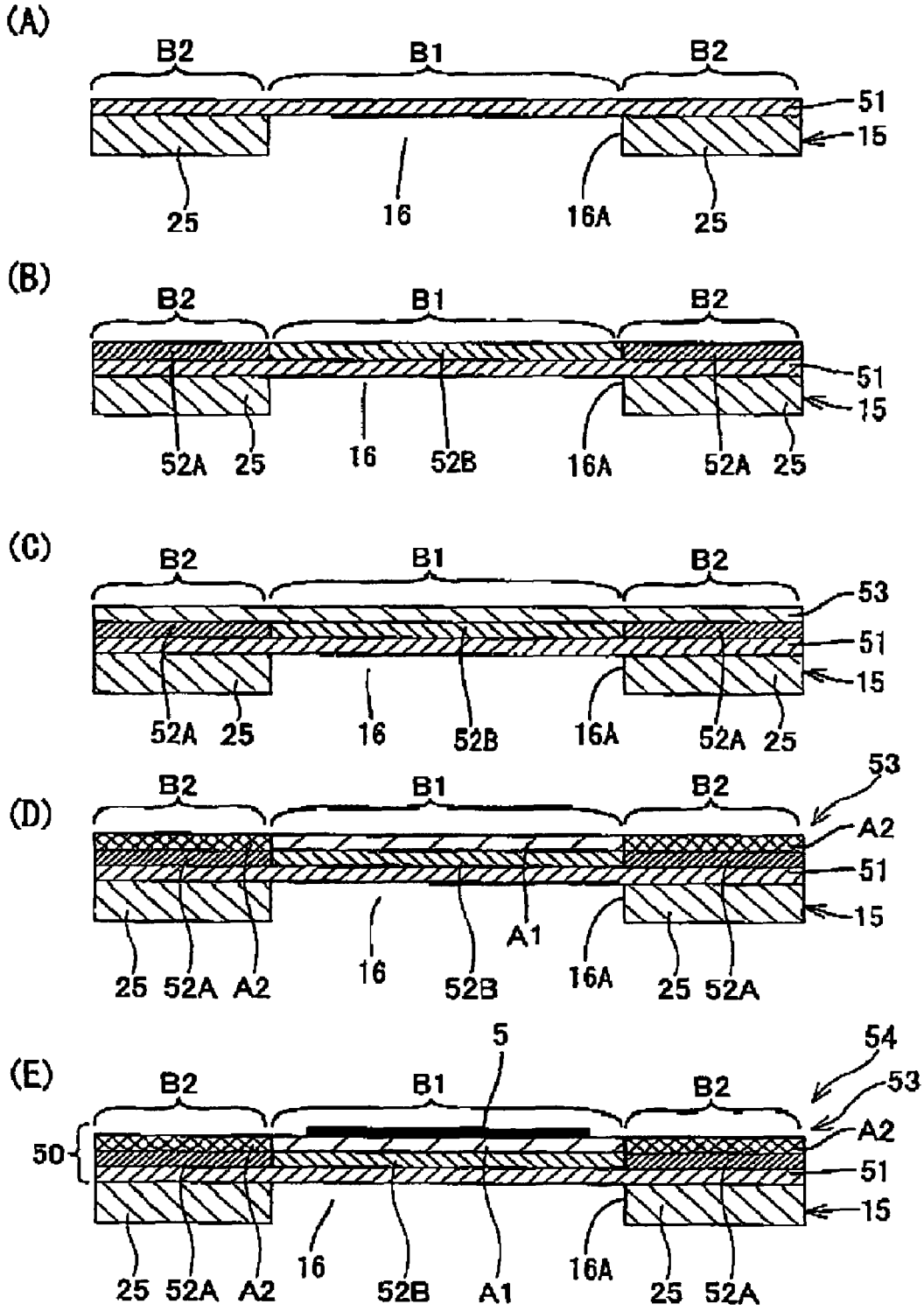
FIG. 5 shows a manufacturing process of a piezo-electric actuator of a third embodiment; (A) shows a state where a vibration plate has been joined with a pressure chamber plate. (B) shows a state where a diffusion material layer has been formed. (C) shows a state where a piezo-electric layer has been formed. (D) shows a state after annealing. (E) shows a state where a top electrode has been formed.

Next, a third embodiment will be described with reference to FIG. 5. In the present embodiment, high piezo-electric characteristic areas are formed, and an element that promotes piezo-electric characteristics is diffused into these areas. Moreover, components that are identical with the first embodiment have the same reference numbers applied thereto.

As shown in FIG. 5(A), a vibration plate 51 is joined with the upper face of the pressure chamber plate 15. The openings at the upper side of the pressure chambers 16 are sealed by the vibration plate 51. The vibration plate 51 is formed from a conductive metal that does not contain an element that degrades piezo-electric characteristics (e.g. titanium, etc.). The vibration plate 51 simultaneously functions as a bottom electrode. In this embodiment, a common bottom electrode is used.

Next, a first diffusion material layer 52A is formed on the upper face of the area B2 of the vibration plate 51 (see FIG. 5(B)). The first diffusion material layer 52A contains an element (such as Fe) that is diffused into a piezo-electric layer 53 (see FIG. 5(C)) and that degrades piezo-electric characteristics. Further, second diffusion material layers 52B are formed on the upper face of the areas B1 of the vibration plate 51. Each second diffusion material layer 52B contains an element (such as Nb) that is diffused into the piezo-electric layer 53 and that promotes piezo-electric characteristics.

Next, the piezo-electric layer 53 is formed as shown in FIG. 5(C). The piezo-electric layer 53 can be formed by means of the AD method, as in the first embodiment. The piezo electric layer 53 has a portion formed on the upper face of the first diffusion material layer 52A, and portions formed on an upper face of the second diffusion material layers 52B.

Next, an annealing process of the piezo-electric layer 53 is performed (see FIG. 5(D)). This annealing process is simultaneously combined with a diffusing process for diffusing the Fe contained in the first diffusion material layer 52A toward the piezo-electric layer 53, and with a diffusing process for diffusing the Nb contained in the second diffusion material layer 52B toward the piezo-electric layer 53. The Fe contained in the first diffusion material layer 52A is diffused into the piezo-electric layer 53 while the Nb contained in the second diffusion material layer 52B is also being diffused into the piezo electric layer 53. The areas A1 of the piezo-electric layer 53 thus become areas in which the Nb has been diffused, and the area A2 of the piezo-electric layer 53 becomes an area in which the Fe has been diffused.

Thereupon, the top electrodes 5 are formed in the same manner as in the first embodiment (see FIG. 5(E)). A piezo-electric actuator 50 is completed by performing the polarization process.

In the present embodiment, the element that degrades the piezo-electric characteristics of the piezo-electric layer 53 is diffused into the area A1 of the piezo-electric layer 53. There is degradation in the piezo-electric effect of the area A2 of the piezo-electric layer 53, and the strength of the driving electric field increases. The element that promotes the piezo-electric characteristics of the piezo-electric layer 53 is diffused into the areas A1 of the piezo-electric layer 53. There is an increase in the piezo-electric effects of the areas A1 of the piezo-electric layer 53, and the strength of the driving electric field decreases.

In the present embodiment, there is a large difference between the strength of the driving electric field of the areas A1 and the area A2. As a result, it is possible to reduce the crosstalk phenomenon more effectively with an ink jet head 54 of the present embodiment.

Further detail will now be given with reference to experiments.

(Experiment 1)

A. Formation of the Piezo-Electric Layer (i) Layer Formation

A stainless steel plate (SUS 430) was used for the base plate (the vibration plates 2, 41, 51). PZT with an average particle diameter of 0.3 to 1 μm was used for the material particles M. A layer forming device as described above in the embodiments was used. Nozzle openings were 0.4×10 mm. The pressure in the layer forming chamber was 200 Pa. The pressure in the aerosol housing was 30000 Pa. The carrier gas was He. Gas flow quantity was 2.0 liters/min. The distance between the nozzle and the base plate was 10 to 20 mm. The piezo-electric layer was formed by blowing the aerosol onto the base plate. The thickness of the piezo-electric layer measured by a surface roughness meter was approximately 8 μm.

(ii) Annealing Process

The annealing process of the piezo-electric layer was performed under the following conditions (termed annealing conditions A). A muffle furnace (Yamato Scientific Co., Ltd. FP Series) was raised to 850° C. The base plate having the piezo-electric layer formed therein was place in the muffle furnace of 850° C., and maintained therein for 0.5 minutes. After that, the base plate was removed from the furnace and allowed to cool to room temperature by self cooling.

B. Experiments

Masking was performed by using adhesive resin tape on the piezo-electric layer. A top electrode having a significant area of more than 3.6 $mm^2$ was formed by using an Au vapor deposition device. A stainless steel base plate (SUS 430) was used for the bottom electrode. The polarization process was then performed by applying an electric field of 300 kV/cm. This completed the piezo-electric actuator.

Various values of the electric field were applied to the piezo-electric actuator. Capacitance for each value of the electric field was measured by means of a ferroelectric tester (TF ANALYZER 2000; Aixacht Technologies). A graph with electric field on the X-axis and capacitance on the Y-axis was made. Then a hysteresis curve of electric field and capacitance was obtained. A remnant polarization (Pr) and a coercive field (Ec) were calculated based on the hysteresis curve. The remnant polarization (Pr) is a value of the capacitance where the electric field is zero. The coercive field (Ec) is an absolute value of the electric field where the capacitance is zero.

(Experiment 2)

A piezo-electric layer with a thickness of approximately 8.5 μm was formed in the same manner as in experiment 1. The annealing process was performed under the annealing conditions A. Here, the annealing time was 1 minute. The same experiments were performed on this piezo-electric layer as in experiment 1.

(Experiment 3)

A piezo-electric layer with a thickness of approximately 5 μm was formed in the same manner as in experiment 1. The annealing process was performed under the annealing conditions A. Here, the annealing time was 3 minutes. The same experiments were performed on this piezo-electric layer as in experiment 1. The applied electric field was 400 kV/cm.

Experiment 4

A piezo-electric layer with a thickness of approximately 5 μm was formed in the same manner as in experiment 1. The annealing process was performed under the annealing conditions A. Here, the annealing temperature was 750° C. The annealing time was 3 minutes. The same experiments were performed on this piezo-electric layer as in experiment 1. The applied electric field was 400 kV/cm.

(Experiment 5)

A piezo-electric layer with a thickness of approximately 8.5 μm was formed in the same manner as in experiment 1. The annealing process of the piezo-electric layer was performed under the following conditions (termed annealing conditions B). The base plate having the piezo-electric layer formed thereon was placed within a muffle furnace identical with that of experiment 1. After that, temperature was raised to 850° C. at 300° C./h. The temperature of 850° C. was maintained for 2 minutes, the temperature of the furnace was then reduced to room temperature by means of self cooling. The base plate was then taken out.

The same experiments were performed on this annealed piezo-electric layer as in experiment 1. The applied electric field was 400 kV/cm.

(Experiment 6)

A piezo-electric layer with a thickness of approximately 8 μm was formed in the same manner as in experiment 1. The annealing process was performed under the annealing conditions B. Here, the annealing time was 5 minutes. The same experiments were performed on this piezo-electric layer as in experiment 1. The applied electric field was 400 kV/cm.

(Experiment 7)

A piezo-electric layer with a thickness of approximately 8 μm was formed in the sane manner as in experiment 1. The annealing process was performed under the annealing conditions B. Here, the annealing time was 30 minutes. The same experiments were performed on this piezo-electric layer as in experiment 1. The applied electric field was 400 kV/cm.

(Experiment 8)

A piezo-electric layer with a thickness of approximately 8.5 μm was formed in the same manner as in experiment 1. The annealing process was performed under the annealing conditions B. Here, the annealing temperature was 800° C. The same experiments were performed on this piezo-electric layer as in experiment 1. The applied electric field was 400 kV/cm.

(Experiment 9)

A stainless steel (SUS 304) plate was used as the base plate. A piezo-electric layer with a thickness of approximately 8 μm was formed on this base plate in the same manner as in experiment 1. The annealing process was performed under the annealing conditions B. Here, the annealing temperature was 700° C. The same experiments were performed on this piezo-electric layer as in experiment 1. The applied electric field was 400 kV/cm.

(Experiment 10)

A stainless steel (SUS 430) plate was used as the base plate. A diffusion material layer containing Ni—Cr was formed on approximately the entire area of an upper face of the base plate. A piezo-electric layer with a thickness of approximately 10 μm was formed in the same manner as in experiment 1 on this base plate provided with the diffusion material layer. The annealing process was performed under the annealing conditions B. Here, the annealing temperature was 800° C. The same experiments were performed on this piezo-electric layer as in experiment 1. The applied electric field was 350 kV/cm.

(Experiment 11)

A stainless steel (SUS 430) plate was used as the base plate. A diffusion material layer containing Ni was formed on approximately the entire area of the upper face of the base plate. A piezo-electric layer with a thickness of approximately 10 μm was formed in the same manner as in experiment 1. The annealing process was performed under the annealing conditions B. Here, the annealing temperature was 800° C. The same experiments were performed on this piezo-electric layer as in experiment 1.

(Comparison 1)

An alumina base plate was used as the base plate. A paste layer with a thickness of approximately 8 μm was formed on the base plate using Au paste (Tanaka Kikinzoku Kogyo; TR 1533). The bottom electrode was formed by baking at 850° C. A piezo-electric layer formed in the same manner as in experiment 1 was formed on the base plate provided with this bottom electrode. The annealing process was performed under the annealing conditions B. Here, the annealing time was 30 minutes. The same experiments were performed on this piezo-electric layer as in experiment 1. The applied electric field was 286 kV/cm.

The results of the aforementioned experiments are shown in Table 1.

TABLE 1

| | | | Annealing | | | Thick. | Electric Field | Pr | Ec | |
|---|---|---|---|---|---|---|---|---|---|---|
| No. | Plate | El. | Con. | ° C. | min | μm | kV/cm | μC/cm$^2$ | kV/cm | Pr/Ec |
| Ex. 1 | SUS430 | Fe | A | 850 | 0.5 | 8 | 300 | 30 | 72 | 0.42 |
| Ex. 2 | SUS430 | Fe | A | 850 | 1 | 8.5 | 300 | 33 | 64 | 0.52 |
| Ex. 3 | SUS430 | Fe | A | 850 | 3 | 5 | 400 | 37 | 68 | 0.54 |
| Ex. 4 | SUS430 | Fe | A | 750 | 3 | 5 | 400 | 33 | 74 | 0.45 |
| Ex. 5 | SUS430 | Fe | B | 850 | 2 | 8.5 | 400 | 22 | 220 | 0.10 |
| Ex. 6 | SUS430 | Fe | B | 850 | 5 | 8 | 400 | 24 | 195 | 0.12 |
| Ex. 7 | SUS430 | Fe | B | 850 | 30 | 8 | 400 | 22 | 220 | 0.10 |
| Ex. 8 | SUS430 | Fe | B | 800 | 2 | 8.5 | 400 | 22 | 220 | 0.10 |
| Ex. 9 | SUS304 | Fe | B | 700 | 2 | 8 | 400 | 18 | 113 | 0.16 |
| Ex. 10 | SUS430 | Ni—Cr | B | 800 | 2 | 10 | 350 | 30 | 110 | 0.27 |
| Ex. 11 | SUS430 | Ni | B | 800 | 2 | 10 | — | — | — | — |
| Com. | $Al_2O_3$ + Au | — | B | 850 | 30 | — | 286 | 27 | 50 | 0.54 |

In comparison 1, in which the element that degrades piezo-electric effects has not been diffused into the piezo-electric layer, the Ec was approximately 50, and Pr/Ec was approximately 0.54.

In experiments 1 to 9, the Fe or Cr contained in the stainless steel base plate was diffused into the piezo-electric layer by means of the annealing process. In the case where the annealing process was performed under the annealing conditions A (experiments 1 to 4), little Fe or Cr was diffused into the piezo-electric layer. The coercive electric field Ec was scarcely larger than in comparison 1, and the Pr/Ec was scarcely smaller than in comparison 1. There was not an appreciable difference compared to the case in which the element that degrades piezo-electric effects had not been diffused. By contrast, in the case where the annealing process was performed under the annealing conditions B (experiments 5 to 9), Fe or Cr was diffused adequately into the piezo-electric layer. As a result, the coercive electric field Ec was much larger than in comparison 1, and the Pr/Ec was greatly reduced. It can be seen that piezo-electric characteristics have greatly degraded.

In experiment 10, the Ni and Cr contained in the diffusion material layer passed through the piezo-electric layer and were spread thinly across the upper face of the piezo-electric layer. The coercive electric field Ec was greater than in the case where the elements were not diffused. However, the rate of increase was less than in the case where the Fe or Cr was diffused from the stainless steel base plate.

Furthermore, in experiment 11, there was a large current leak probably caused by the diffusion of the Ni, and the piezo-electric characteristics could not be measured.

According to the present representative embodiments, it is possible to effectively degrade the piezo-electric characteristics by having the element that degrades piezo-electric characteristics diffused toward the piezo-electric layer under appropriate annealing conditions. For example, the piezo-electric characteristics can be reduced further by using the annealing conditions B. Further, for example, the piezo-electric characteristics can be reduced by having the Fe or Cr diffused from the stainless steel base plate.

According to the present representative embodiments, it is possible to increase the difference between the piezo-electric characteristics of the high piezo-electric characteristic areas and the piezo-electric characteristics of the low piezo-electric characteristic area.

The technical range of the present invention is not restricted to the embodiments described above. For example, the following representative examples are also encompassed in the technical range of the present invention.

(1) In the aforementioned embodiments, the element that is diffused in the piezo-electric layer differed from the element that constitutes the piezo-electric layer. However, the element that is diffused in the piezo-electric layer may equally well be the same element that constitutes the piezo-electric layer, as long as this element is capable of degrading the piezo-electric characteristics of the piezo-electric layer when it is diffused therein. Further, the element that is diffused in the piezo-electric layer may equally well be the same element that constitutes the piezo-electric layer, as long as this element is capable of promoting the piezo-electric characteristics of the piezo-electric layer when it is diffused therein.

(2) In the aforementioned embodiments, the element that degrades the piezo-electric characteristics of the piezo-electric layer is diffused in the entirety of the portions of the piezo-electric layer 4 corresponding to the area B2. However, the element may equally well not be diffused in the entirety of the portions corresponding to the area B2. Instead, the element may be diffused in an area that is wider than the area B2. In this case, the high piezo-electric characteristic areas A1 of the piezo-electric layer become narrower, and the low piezo-electric characteristic area A2 becomes wider. Moreover, the elements may be diffused in an area narrower than the area B2. In this case, the high piezo-electric characteristic areas A1 of the piezo-electric layer become wider, and the low piezo-electric characteristic area A2 becomes narrower.

(3) In the first embodiment, the bottom electrodes (the protecting layer) 3 were formed by the screen printing method. However, the method of forming the protecting layer is not restricted to the method in the aforementioned embodiment. For example, masking may first be performed of portions corresponding to the area B2 of the vibration plate, and then the protecting layer may be formed by the AD method.

Figure 6:
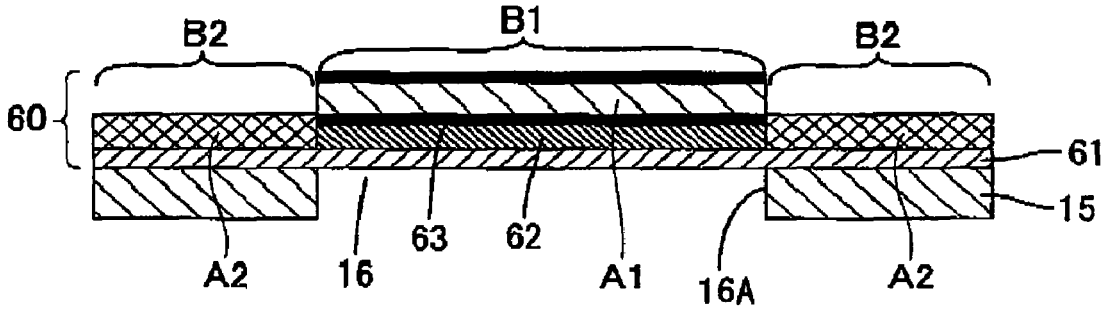
FIG. 6 shows a cross-sectional view of a piezo-electric actuator of a differing embodiment.

(4) In the first embodiment, the bottom electrodes simultaneously function as the protecting layer. However, the bottom electrodes and the protecting layer may be separate bodies. For example, a piezo-electric actuator 60 shown in FIG. 6 can be used. A protecting layer is formed above a vibration plate 61. A bottom electrode 63 is formed on an upper face of the protecting layer 62. The bottom electrode 63 and the protecting layer 62 are separate bodies.

(5) In the second and third embodiments, the vibration plate is formed from a conductive material. The vibration plate simultaneously functions as a bottom electrode. However, a common bottom electrode may equally well be formed separately on the upper face of the vibration plate. In this case, a nonconductive base plate formed from, for example, alumina zirconia, etc. can be used as the vibration plate.

(6) In the third embodiment, the high piezo-electric characteristic areas A1 are formed by diffusing the element that promotes piezo-electric characteristics. Further, the low piezo-electric characteristic area A2 is formed by diffusing the element that degrades piezo-electric characteristics. However, the low piezo-electric characteristic area A2 does not necessarily have to be formed by diffusing the element that degrades piezo-electric characteristics. It is equally possible to diffuse only the element that promotes piezo-electric characteristics toward the piezo-electric layer.

(7) In the aforementioned embodiments, the vibration plate is joined with the pressure chamber plate, and then the bottom electrode, the piezo-electric layer, the top electrodes, etc. are formed on the upper face of the vibration plate. However, the bottom electrode, the piezo-electric layer and the top electrodes may first be formed on the vibration plate, and then the vibration plate may be joined with the pressure chamber plate.

(8) In the aforementioned embodiments, the piezo-electric layer is formed by means of the AD method. However, CVD method, sputtering method, sol-gel method, or MOD method may be used to form the piezo-electric layer.

(9) In the aforementioned embodiments, Fe annealing process is simultaneously combined with the diffusing process. However, the diffusing process can be performed before or after the annealing process. Moreover, in the case where the sol-gel method etc. is used to form the piezo-electric layer, a sintering process may be simultaneously combined with the diffusing process.

(10) In the aforementioned embodiments, the piezo-electric actuator has only one piezo-electric layer. The technique disclosed in this specification may be applied to a piezo-electric actuator having a plurality of piezo-electric layers.

(11) In the aforementioned embodiments, a technique of the present invention is utilized for the ink jet head of the ink jet printer. However, the technique of the present invention can be utilized for another field. For example, this technique may be utilized for a device for manufacturing a printed circuit board. This device forms an electric wiring pattern by discharging an electric conducting material. The technique of the present invention may be applied to an electric conducting material discharge head. Also, the technique of the present invention may be applied to a droplet discharge head for a molten resin discharge device. This molten resin discharge device may manufacture a three dimensional object formed by resin.

Furthermore, the piezo-electric actuator of the present invention may be applied to the electric conducting material discharge head or the droplet discharge head Also, the piezo-electric actuator may be applied to a driving device of a small pump or micro-motor, a tremor device mounted on a precision instrument, and a part of a display device.

The mechanism whereby the piezo-electric characteristics are degraded by diffusing the elements will now be described. Here, lead zirconate titanate (PZT) is used as the piezo-electric material. The PZT has a perovskite crystal structure that is expressed by $ABO_3$. $Pb^{2+}$ is located at the A site. $Zr^{4+}$ and $Ti^{4+}$ are located at the B site. When the electric field is applied, ions of the B site move toward the electric field direction. $O^{2-}$ ions move toward an opposite direction of the electric field direction. Electric polarization occurs. When, $Fe^{3+}$, for example, is diffused into the PZT, oxygen is depleted and the B site is swapped. Generating this oxygen depletion restricts the movement of a domain wall and, as a result, the coercive electric field increases. Further, the same effect is achieved if, for example, $Ki^{+}$ is swapped at the A site.

The piezo-electric material and the elements for degrading the piezo-electric characteristics may be combined in any combination which generates the aforementioned mechanism. The piezo-electric material may be, for example, lead zirconate titanate (PZT), barium titanate, lead titanate, lead magnesium niobate (PMN), lead nickel niobate (PNN), or lead zinc niobate. The piezo-electric material may be, for example, formed by adding a minute amount of any of the following to lead zirconate titanate (PZT): barium, niobium, zinc, nickel, or manganese. Further, the element that is diffused into the piezo electric layer and degrades the piezo-electric characteristics may be, for example, iron, chrome, cobalt, manganese, silica, aluminum, etc. These piezo-electric materials and elements may be used singly, or as combinations of two or more.

The mechanism for promoting piezo-electric characteristics by means of diffusing elements will now be described. Here, lead zirconate titanate (PZT) is used as the piezo-electric material.

When, for example, $Nb^{5+}$ is diffused into the PZT, the B site is swapped and vacancies are formed in the A site. It is easy for a domain wall to move via these vacancies. As a result, the coercive electric field decreases. Further, the same effect is achieved if, for example, $La^{3+}$ is swapped on the A site.

The piezo-electric material and the elements for promoting piezo-electric characteristics may be combined in any combination which generates the aforementioned mechanism. The piezo-electric material may be, for example, lead zirconate titanate (PZT), barium titanate, lead titanate, lead magnesium niobate (PMN), lead nickel niobate (PNN), or lead zinc niobate. The piezo-electric material may be, for example, formed by adding a minute amount of any of the following to the lead zirconate titanate (PZT): barium, niobium, zinc, nickel, or manganese. Furthermore, the element that is diffused into the piezo-electric layer and promotes piezo-electric characteristics may be, for example: calcium, strontium, magnesium, barium, cadmium, lanthanum, neodymium, niobium, antimony, bismuth, thorium, tungsten, etc. These piezo-electric materials and elements may be used singly, or as combinations of two or more.

According to the technique taught in the present specification, elements that promote piezo-electric characteristics are diffused into 'areas facing the pressure chambers' of the piezo-electric layer of the piezo-electric actuator. Alternatively, elements that degrade piezo-electric characteristics are diffused into 'area not facing the pressure chambers' of the piezo-electric layer. Further, the term 'areas facing the pressure chambers' refers to substantially facing the pressure chambers. The size of these areas may be varied within a range that allows the effects to be obtained of the technique taught in the present specification. Similarly, the term 'area not facing the pressure chambers' refers to substantially not facing the pressure chambers. The size of this area may be varied within a range that allows the effects to be obtained of the technique taught in the present specification. The term 'facing' used in the present specification refers to 'substantially facing' within a range that allows the effects to be obtained of the technique taught in the present specification. Furthermore, the term 'facing' used in the present specification does not necessarily refer to two members facing one another directly. The term 'facing' also includes the case where members are indirectly facing one another via another member.

In the case where elements that degrade piezo-electric characteristics have been diffused into the 'area not facing the pressure chambers' of the piezo-electric layer, the coercive electric field is increased by the effects of the elements. The strength of the driving electric field therefore increases. That is, there is almost no deformation due to the normal driving electric field in this area (the low piezo-electric characteristic area). As a result, when voltage is applied to one of the high piezo-electric characteristic areas and this area is deformed, the adjoining low piezo-electric characteristic area is barely deformed. The occurrence of the crosstalk phenomenon can therefore be effectively reduced.

In the case where elements that promote piezo-electric characteristics have been diffused into the 'areas facing the pressure chambers' of the piezo-electric layer, the coercive electric field is decreased by the effects of the elements. The strength of the driving electric field therefore decreases. That is, this area (the high piezo-electric characteristic area) becomes an area that is deformed by the low driving electric field. The piezo-electric actuator can be driven with a driving electric field having strength such that the high piezo-electric characteristic areas are deformed, but the low piezo-electric characteristic area is not deformed. In this case, the high piezo-electric characteristic areas are deformed, whereas the adjoining low piezo-electric characteristic area is barely deformed. The occurrence of the crosstalk phenomenon can therefore be effectively reduced.

A method may be used in which the diffusion material layer containing the elements for either degrading or promoting piezo-electric characteristics is formed on a surface of the base plate. Alternatively, a method may be used in which the protecting layer for preventing the diffusion of the elements is formed on the surface of the base plate that contains the elements for either degrading or promoting piezo-electric characteristics. Conventionally, the base plate containing elements for degrading piezo-electric characteristics could not easily be used as the base plate for the piezo-electric actuator. However, by using the latter method, this base plate can be utilized positively as a supply source of diffusion material.

What is claimed is:

1. An ink jet head comprising:

a channel body comprising a plurality of ink flow channels, each of the ink flow channels having a pressure chamber and a nozzle connected with the pressure chamber; and a piezo-electric actuator stacked on the channel body, the piezo-electric actuator comprising a piezo-electric layer having a plurality of high piezo-electric characteristic areas and a low piezo-electric characteristic area, each of the high piezo-electric characteristic areas facing each of the pressure chambers of the channel body, and the low piezo-electric characteristic area facing an intermediate area between the pressure chambers of the channel body.

2. The ink jet head as in claim 1, wherein the piezo-electric actuator further comprises:

a plurality of first electrodes distributed on a front face of the piezo-electric layer; and a plurality of second electrodes distributed on a back face of the piezo-electric layer, wherein each of the first electrodes and each of the second electrodes face each of the high piezo-electric characteristic areas, respectively.

3. The ink jet head as in claim 2, wherein the piezo-electric actuator further comprises:

a first layer located between the back face of the piezo-electric layer and the channel body, the first layer directly covering the pressure chambers and the intermediate area, and the first layer including a first element for degrading piezo-electric characteristics of the piezo-electric layer.

4. The ink jet head as in claim 3, wherein the first element is different from a principal element of the piezo-electric layer.

5. The inkjet head as in claim 3, wherein the first element is selected from a group consisting of iron, chrome, cobalt, manganese, silica, and aluminum.

6. The ink jet head as in claim 1, wherein the piezo-electric actuator further comprises:

a plurality of first electrodes distributed on a front face of the piezo-electric layer; and a second electrode provided on a back face of the piezo-electric layer, wherein each of the first electrodes faces each of the high piezo-electric characteristic areas, and the second electrode directly covers the pressure chambers and the intermediate area.

7. The ink jet head as in claim 6, wherein the piezo-electric actuator further comprises:

a second layer located between the piezo-electric layer and the second electrode, the second layer facing the low piezo-electric characteristic area and not facing the high piezo-electric characteristic areas, and wherein the second electrode includes a first element for degrading piezo-electric characteristics of the piezo-electric layer.

8. The ink jet head as in claim 1, the wherein piezo-electric actuator further comprises:

a plurality of third layers, each of the third layers facing each of the high piezo-electric characteristic areas, each of the third layers including a second element for promoting piezo-electric characteristics of the piezo-electric layer.

9. The ink jet head as in claim 8, wherein the second element is selected from a group consisting of calcium, strontium, magnesium, barium, cadmium, lanthanum, neodymium, niobium, antimony, bismuth, thorium, and tungsten.

10. The ink jet head as in claim 8, wherein the piezo-electric actuator further comprises:

a fourth layer facing the low piezo-electric characteristic area and not facing the high piezo-electric characteristic areas, the fourth layer including a first element for degrading piezo-electric characteristics of the piezo-electric layer.

11. The ink jet head as in claim 1, wherein the piezo-electric layer includes a piezo-electric material selected from a group consisting of lead zirconate titanate (PZT), barium titanate, lead titanate, lead magnesium niobate (PMN), lead nickel niobate (PNN), and lead zinc niobate.

12. A piezo-electric actuator comprising:

a piezo-electric layer having a plurality of high piezo-electric characteristic areas and a low piezo electric characteristic area; and a plurality of individual electrodes, each of the individual electrodes facing each of the high piezo-electric characteristic areas.

13. The piezo-electric actuator as in claim 12, wherein the piezo-electric actuator is to be connected with a channel body comprising a plurality of ink flow channels, each ink flow channel having a pressure chamber and a nozzle connected with the pressure chamber.

14. The piezo-electric actuator as in claim 13, wherein each of the high piezo-electric characteristic areas faces each of the pressure chambers of the channel body, and the low piezo-electric characteristic area faces an intermediate area between the pressure chambers of the channel body.

* * * * *